US005710399A

United States Patent [19]

Castonguay et al.

[11] Patent Number: 5,710,399

[45] Date of Patent: Jan. 20, 1998

[54] ELECTRONIC TRIP UNIT CONVERSION KIT FOR HIGH AMPERE-RATED CIRCUIT BREAKERS

[75] Inventors: Roger N. Castonguay, Terryville; Jeffrey D. Lord, Unionville, both of Conn.

[73] Assignee: General Electric Company, New York, N.Y.

[21] Appl. No.: 640,612

[22] Filed: May 1, 1996

[51] Int. Cl.[6] ..... H01H 3/00; H01H 73/100

[52] U.S. Cl. ..... 200/17 R; 335/18

[58] Field of Search ..... 200/17 R; 335/18, 335/20, 26, 132

[56] References Cited

U.S. PATENT DOCUMENTS

| | | | |
|---|---|---|---|
| 3,073,936 | 1/1963 | Baird | 200/168 |
| 3,761,778 | 9/1973 | Willard | 317/33 R |
| 4,246,558 | 1/1981 | Zubaty et al. | 335/20 |
| 4,672,501 | 6/1987 | Bilac et al. | 361/96 |
| 4,679,019 | 7/1987 | Todaro et al. | 335/172 |
| 4,814,738 | 3/1989 | Krasser et al. | 337/66 |
| 4,860,157 | 8/1989 | Russell | 361/156 |

OTHER PUBLICATIONS

U.S. Application No. 08/551640 filed 11 Nov. 1995 Castonguay & Lord.

*Primary Examiner*—Stuart N. Hecker

*Attorney, Agent, or Firm*—Richard A. Menelly; Carl B. Horton

[57] ABSTRACT

A field-installable circuit breaker trip actuator unit includes a flux shifter unit that interfaces with the circuit breaker operating mechanism and is installable without dismantling the circuit breaker components. The flux shifter unit responds to an electronic trip unit to articulate the circuit breaker operating mechanism and separate the circuit breaker contacts upon occurrence of an overcurrent condition. A reset arrangement allows the trip actuator unit to be automatically reset upon completion of the contact separation process.

21 Claims, 3 Drawing Sheets

ELECTRONIC TRIP UNIT CONVERSION KIT FOR HIGH AMPERE-RATED CIRCUIT BREAKERS

BACKGROUND OF THE INVENTION

High ampere-rated circuit breakers such as described within U.S. Pat. No. 3,073,936 entitled "Electric Circuit Interrupter" are currently employed within industrial manufacturing facilities to protect the electric equipment and buildings from damage due to overcurrent conditions within the electrical distribution system. Earlier manufactured circuit breakers employed thermal-magnetic trip units to determine overcurrent conditions and to articulate the circuit breaker operating mechanism to separate the circuit breaker contacts to interrupt the associated electric circuit. Later manufactured circuit breakers employed electronic trip units which contained so-called "flux shift units" to articulate the operating mechanism upon signal from the electronic trip unit. One example of an early electronic trip unit is found in U.S. Pat. No. 3,761,778 entitled "Static Trip Control Unit for Electric Circuit Breaker".

Such robust circuit breakers remain in operation to this date without needing replacement or repair. However, state of the art digital electronic trip units of the type described within U.S. Pat. No. 4,672,501 entitled "Circuit Interrupter and Controller Unit" provide more reliable protection by closer control over the circuit interruption time and current parameters as well as providing communications and accessory options. It would be economically advantageous to incorporate state of the art digital electronic trip units within such existing circuit breakers without having to dismantle the circuit breaker operating components in the process.

One purpose of the invention, accordingly, is to provide a conversion unit that will incorporate digital electronic trip units within existing circuit breakers without having to dismantle the circuit breaker operating components.

SUMMARY OF THE INVENTION

In accordance with the invention, an electronic trip unit conversion kit includes a flux shift unit and reset arrangement to articulate the circuit breaker operating mechanism upon the occurrence of an overcurrent condition to separate the circuit breaker contacts and to automatically reset the flux shift unit after the circuit breaker contacts have become separated. A connector link interacting between the circuit breaker operating mechanism cross bar and the conversion kit flux shift unit to provide the flux shift unit reset facility.

DESCRIPTION OF THE PREFERRED EMBODIMENT

Figure 1:
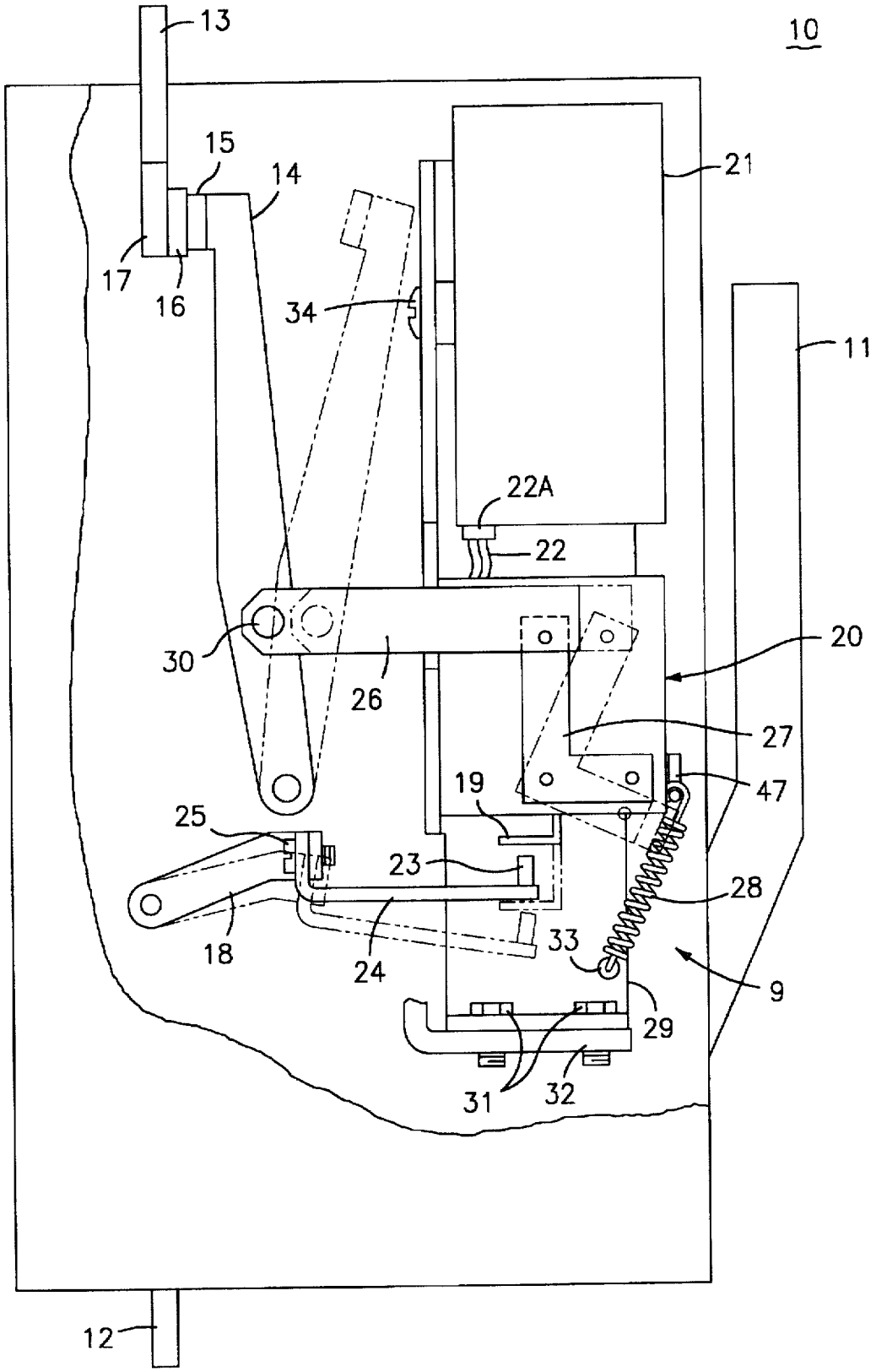
FIG. 1 is a side view of a circuit breaker with a part of the circuit breaker case removed to depict the circuit breaker contact arms, contacts and the circuit breaker trip unit conversion kit in accordance with the invention.

FIG. 1 shows an industrial-rated circuit breaker 10, such as described in aforementioned U.S. Pat. No. 3,073,936, with an operating handle 11 extending from the top with load straps 12 and line straps 13 arranged at opposite ends thereof. The movable contacts 15 at one end of the movable contact arm 14 and the fixed contacts 16 on the contact support 17 are shown in solid lines in the CLOSED condition and in phantom lines in the OPEN condition. The condition of the contacts are controlled by an operating mechanism (not shown) that is refrained from articulation by means of a trip latch 18 in the manner described within the aforementioned U.S. Pat. No. 3,073,936.

Figure 2:
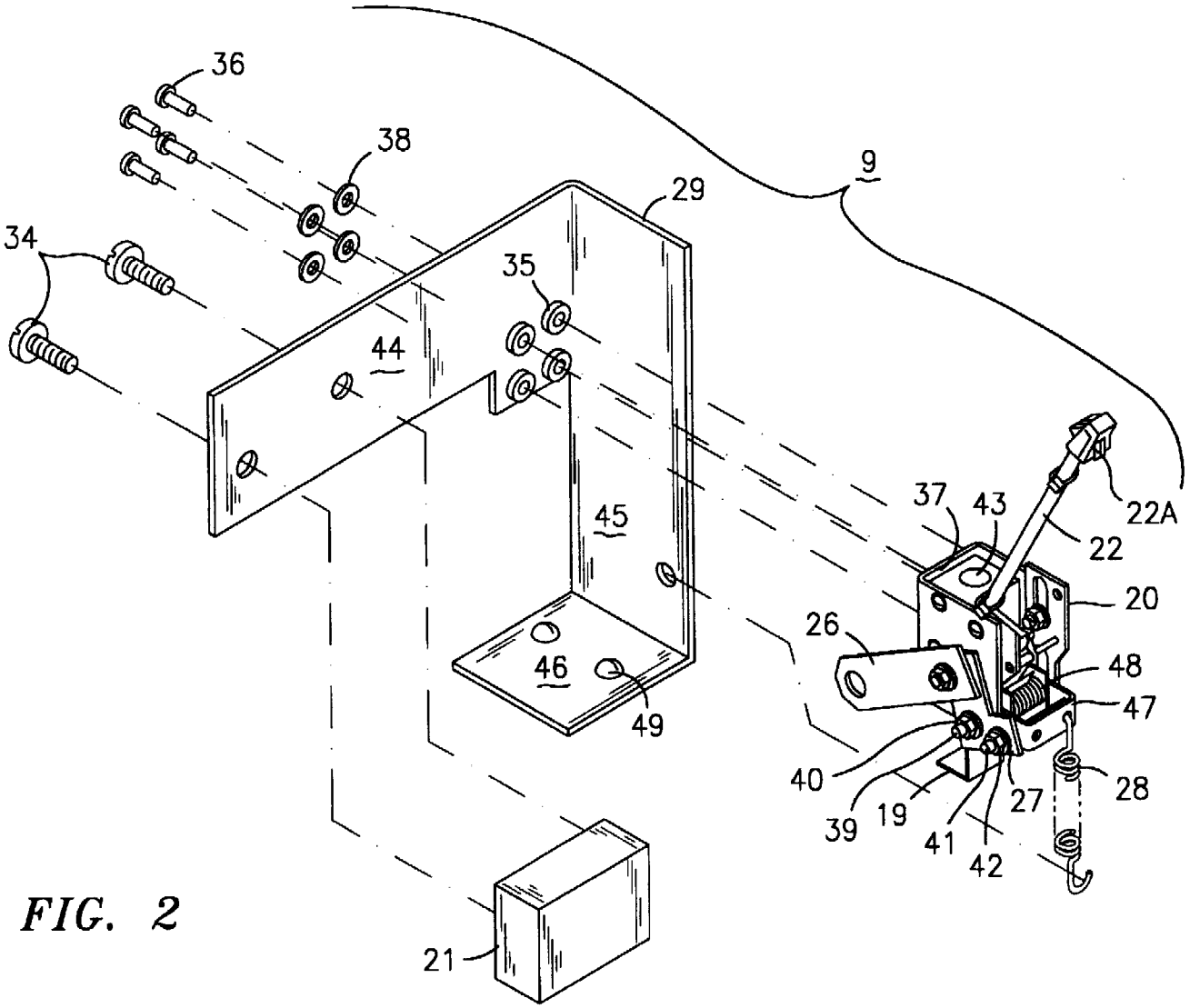
FIG. 2 is a top perspective view of the components of the trip actuator unit within the trip unit conversion kit of FIG. 1.
Figure 3:
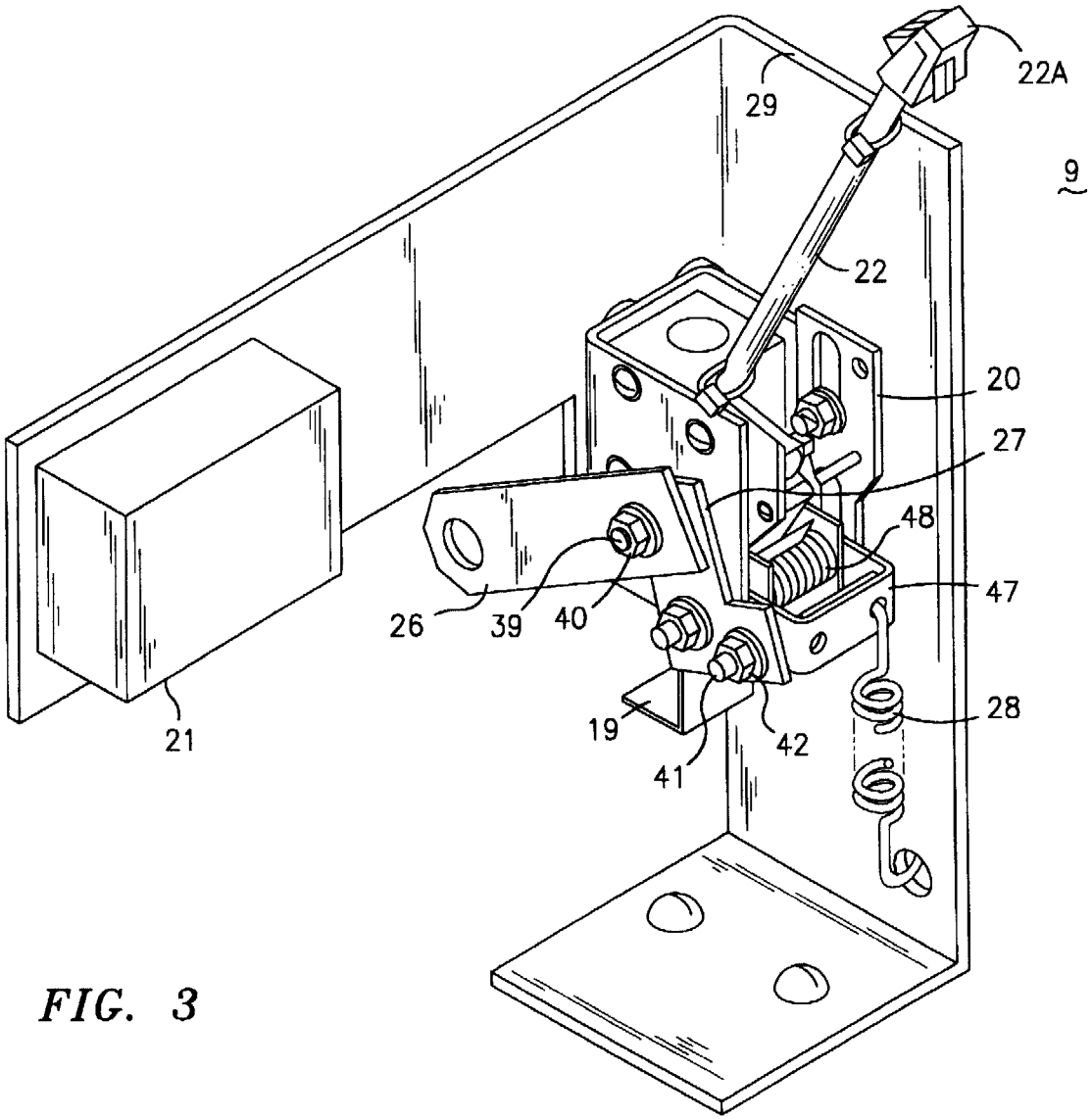
FIG. 3 is an enlarged top perspective view of the trip unit conversion kit of FIG. 1 prior to insertion within the circuit breaker assembly of FIG. 1.

In accordance with the invention, a trip unit conversion kit 9, as shown in FIGS. 2 and 3 along with FIG. 1, includes a programmer or electronic trip unit 21 such as described in aforementioned U.S. Pat. No. 4,672,501 that connects with a trip actuator unit 20 by means of a wire conductor 22 and connectors 22A at one end. The trip unit conversion kit 9 is attached to the interior of the circuit breaker 10 by securing the conversion kit mounting bracket 29 to the circuit breaker accessory bracket 32 by means of screws 31. The trip actuator unit 20 is similar to that described in U.S. patent application Ser. No. 08/551,640 filed Nov. 11, 1995 entitled "Electronic Trip Unit Conversion Kit for High Ampere-Rated Circuit Breakers". Upon receipt of a trip signal from the trip unit, the trip actuator unit 20 releases the flux shift plunger 19 which strikes a trip latch adjusting screw 23. The adjusting screw 23 is threaded into a trip latch extension 24 which is secured to the circuit breaker trip latch 18 by means of a screw 25. The flux shift plunger 19 rotates the trip latch 18 to the position shown in phantom allowing the operating mechanism (not shown) to separate the contacts 15, 16 as further described in the aforementioned U.S. Pat. No. 3,073,936. The connector link 26 is attached to the reset arm 27 within the trip actuator unit 20 at one end and to the circuit breaker crossbar 30 at the other end to return the flux shift plunger 19 within the flux shift unit 43 from the actuated position depicted in solid lines to the reset position shown in phantom. The reset spring 28 which is anchored at one end through a hole 33 in the conversion kit mounting bracket 29 and at the other end to flux shift reset bracket 47, biases the connector link 26, and reset arm 27 immediately upon extension of the connector link to the position shown in phantom and returns the flux shift plunger 19 to its home position when the circuit breaker contacts 15,16 are returned to their closed position. This is brought about by interaction between the connector link 26 with the circuit breaker crossbar 30 at one end and by connection between the connector link 26 with the reset arm 27 at the opposite end, such that the rotation of the cross bar to close the circuit breaker contacts moves the connector link 26 and the reset arm 27 back to the position depicted in solid lines as described in the aforementioned U.S. patent application Ser. No. 08/551,640. As further described therein, the flux shift reset bracket 47 that controls the position of the flux shift plunger 19, is attached to the reset arm 27 by means of bolts 41 and nuts 42.

As shown in FIGS. 2 and 3, the mounting bracket 29 is shaped from a single metal plate and defines a front wall 44 extending in the horizontal plane as viewed in FIG. 2 with a side wall 45 extending in the vertical plane at right angles to the front wall and with a bottom shelf 46 formed at one end. The electronic trip unit 21 is secured to the front wall of the conversion kit mounting bracket 29 with screws 34 and the trip actuator unit 20 is attached to the front wall via rubber grommets 35, washers 38, screws 36 and threaded apertures 37. The rubber grommets are required to prevent the vibration within the circuit breaker interior from interfering with the operation of the flux shift unit 43 that controls the movement of the flux shift plunger 19, described earlier. The bottom shelf 46 includes apertures 49 for connection of the mounting bracket with the circuit breaker accessory bracket 32, as shown in FIG. 1. The connector link 26 is pivotally attached to the reset arm 27 by screw 39 and nut 40. The position of the flux shifter reset bracket 47 is determined by the flux shifter reset spring 48 in the manner described in the aforementioned U.S. patent application Ser. No. 08/551,640. Upon displacement of the connector link 26 by the circuit breaker crossbar 30 in FIG. 1, the reset arm 27 and return spring 28 rotate flux shifter reset bracket 47 against the return bias of the flux shifter reset spring 48 to return the plunger 19 to the home position as shown in solid lines.

An electronic trip unit conversion kit in the form of trip unit having automatic reset facility has herein been described. The conversion kit is mounted within the circuit breaker enclosure without requiring disassembly of any of the circuit breaker components.

We claim:

1. A trip unit conversion kit for circuit breakers comprising:

a trip actuator unit responsive to a trip initiating signal from a circuit breaker trip unit to articulate a circuit breaker operating mechanism and separate a pair of circuit breaker contacts, said trip actuator unit including a flux shift unit having a flux shift plunger;

a reset bracket pivotally arranged on said trip actuator unit and connecting with said flux shift plunger; and a reset arm attached to said reset bracket and a connector link attached to said reset arm and arranged for interacting with a circuit breaker cross bar at an opposite end, whereby said cross bar motivates said connector link and said reset arm and said reset bracket upon separation of said circuit breaker contacts.

2. The trip unit conversion kit of claim 1 including a reset spring attached to said reset bracket for returning said reset arm and said connector link to a home position.

3. The trip unit conversion kit of claim 2 including a support bracket, whereby said opposite end of said connector link passes under said support bracket for alignment with said cross bar.

4. The trip unit conversion kit of claim 3 wherein said reset spring connects with said reset bracket at one end of said return spring and connects with said support bracket at an opposite end of said return spring.

5. The trip unit conversion kit of claim 4 wherein said support bracket supports a circuit breaker electronic trip unit.

6. The trip unit conversion kit of claim 1 wherein said reset arm comprises an L-shaped plate.

7. The trip unit conversion kit of claim 1 where in said reset arm is attached to a reset bracket on said flux shift unit.

8. The trip unit conversion kit of claim 7 wherein said flux shift unit includes a flux shift reset spring.

9. The trip unit conversion kit of claim 3 wherein said trip actuator unit is attached to said support bracket by means of a flexible grommet.

10. The trip unit conversion kit of claim 3 wherein said support bracket comprises a metal plate shaped to define a front wall extending in a first plane, a side wall having a top part extending from said front wall at right angles to said first plane and a shelf extending from a bottom part of said side wall in said first plane.

11. The trip unit conversion kit of claim 10 wherein said shelf is adapted for attachment to a circuit breaker interior bracket.

12. A circuit breaker comprising:

an enclosure;

a pair of contacts within said enclosure for interrupting circuit current on command;

a line strap on one end of said enclosure for connecting said contacts with an electrical source;

a line strap on an opposite end of said enclosure for connecting said contacts with electrical equipment;

an operating handle extending from said enclosure for manual control of an operating mechanism;

electronic means for providing a trip initiating signal to a trip actuator, said trip actuator including:

a flux shift unit having a flux shift plunger and a flux shift plunger reset bracket;

a reset arm pivotally arranged on said trip actuator unit and connecting with said reset bracket; and a connector link attached to said reset arm at one end and arranged for interacting with a circuit breaker cross bar at an opposite end, whereby said cross bar motivates said connector link and said reset arm upon separation of said circuit breaker contacts.

13. The circuit breaker of claim 12 including a support bracket, whereby said opposite end of said connector link passes under a part of said support bracket for alignment with said circuit breaker cross bar.

14. The circuit breaker of claim 13 including a reset spring attached between said reset bracket and said support bracket for returning said reset bracket and said connector link to a home position.

15. The circuit breaker of claim 13 wherein said support bracket supports a circuit breaker electronic trip unit.

16. The circuit breaker of claim 13 wherein said reset arm comprises an L-shaped plate.

17. The circuit breaker of claim 13 wherein said reset arm is attached to a reset bracket on said flux shift unit.

18. The circuit breaker of claim 13 wherein said flux shift unit includes a flux shift reset spring.

19. The circuit breaker of claim 13 wherein said trip actuator unit is attached to said support bracket by means of a flexible grommet.

20. The circuit breaker of claim 13 wherein said support bracket comprises a metal plate shaped to define a front wall extending in a first plane, a side wall having a top part extending from said front wall at right angles to said first plane and a shelf extending from a bottom part of said side wall in said first plane.

21. The circuit breaker of claim 13 wherein said shelf is adapted for attachment to a circuit breaker interior bracket.

* * * * *